US007304560B2

(12) United States Patent
Yu

(10) Patent No.: US 7,304,560 B2
(45) Date of Patent: Dec. 4, 2007

(54) SAFETY SWITCHES

(76) Inventor: Tsung Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 355 days.

(21) Appl. No.: 11/203,635

(22) Filed: Aug. 12, 2005

(65) Prior Publication Data

US 2007/0035377 A1 Feb. 15, 2007

(51) Int. Cl.
*H01H 37/70* (2006.01)
*H01H 37/52* (2006.01)
*H01H 37/18* (2006.01)

(52) U.S. Cl. ..... 337/94; 337/56; 337/72; 337/66

(58) Field of Classification Search ..... 337/56, 337/72, 66, 94; 200/339, 341
See application file for complete search history.

(56) References Cited

U.S. PATENT DOCUMENTS 3,932,829 A * 1/1976 Ellenberger ..... 337/49
4,258,349 A * 3/1981 Flory ..... 337/46
4,329,669 A * 5/1982 Krasser et al. ..... 335/20
4,338,586 A * 7/1982 Scanlon ..... 337/74
4,345,233 A * 8/1982 Matthies ..... 337/75
4,528,538 A * 7/1985 Andersen ..... 337/43
4,833,439 A * 5/1989 Bowden et al. ..... 337/68
4,922,219 A * 5/1990 Bakhaus et al. ..... 337/74
5,089,799 A * 2/1992 Sorenson ..... 337/68
5,223,813 A * 6/1993 Cambreleng et al. ..... 337/66
5,262,748 A * 11/1993 Tsung-Mou ..... 337/66
5,264,817 A * 11/1993 Sorenson ..... 337/68
5,491,460 A * 2/1996 Krasser et al. ..... 337/70
5,539,371 A * 7/1996 Yu ..... 337/66
5,760,672 A * 6/1998 Wang ..... 337/79
5,892,426 A * 4/1999 Huang ..... 337/59
6,275,134 B1 * 8/2001 Chen ..... 337/37
6,307,460 B1 * 10/2001 Yu ..... 337/37
6,400,250 B1 * 6/2002 Wang ..... 337/66
6,445,273 B1 * 9/2002 Yu ..... 337/37
6,456,185 B1 * 9/2002 Yu ..... 337/37
6,512,441 B1 * 1/2003 Yu ..... 337/37
6,525,639 B1 * 2/2003 Cheng ..... 337/37
6,552,644 B2 * 4/2003 Yu ..... 337/66
6,563,414 B2 * 5/2003 Yu ..... 337/66
6,577,221 B1 * 6/2003 Wang ..... 337/59
6,617,952 B1 * 9/2003 Yu ..... 337/94

(Continued)

FOREIGN PATENT DOCUMENTS

FR 2605142 A1 * 4/1988

*Primary Examiner*—Anatoly Vortman

(57) ABSTRACT

A safety switch includes a switch member and a push rod is pivotably connected to an inside of the switch member. A biasing member pushes the push rod toward a stop rod extending from the inside of the switch member. A bi-metallic contact plate has a first end fixed to one of two terminals and a contact portion splits from the contact plate. A first contact point is connected to an underside of the contact portion and a second contact point is connected to the other terminal. A free end of the contact portion is connected with a free first end of a spring member and a second end of the spring member is connected to the contact plate. When overloaded, the contact portion and the spring member move clockwise to cut off the circuit while the push rod does not stop the clockwise movement of the spring member.

7 Claims, 4 Drawing Sheets

U.S. PATENT DOCUMENTS 6,621,402 B2 * 9/2003 Huang ..... 337/66
6,664,884 B1 * 12/2003 Yu ..... 337/59
6,674,033 B1 * 1/2004 Wang ..... 200/334
6,714,116 B1 * 3/2004 Sang et al. ..... 337/68
6,734,779 B2 * 5/2004 Yu ..... 337/59
6,788,186 B1 * 9/2004 Yu ..... 337/66
6,864,453 B1 * 3/2005 Yu ..... 200/520
6,940,389 B1 * 9/2005 Yu ..... 337/66
7,030,726 B2 * 4/2006 Yu ..... 337/66
2003/0160679 A1 * 8/2003 Yu ..... 337/37
2005/0140489 A1 * 6/2005 Kuo ..... 337/66

* cited by examiner

SAFETY SWITCHES

BACKGROUND OF THE INVENTION

1. Field of the Invention

The present invention relates to a safety switch that ensures the bimetallic plate to be deformed as desired when overloaded and the switch member is pivoted to "OFF" position.

2. The Prior Arts

A conventional switch device, especially for those switches using bimetallic plate to prevent from being burned when an overload is happened, generally includes a bimetallic plate which is deformed when overloaded so as to separate the two contact points respectively located on the bimetallic plate and one of the two terminals. Some inherent shortcomings for these conventional safety switches are experienced. There are too many parts involved in the safety switches and a longer period of time is required when assembling the switches, so this increases the cost of the products. The parts might be arranged inaccurately and affect the deformation of the bimetallic plate. Once the bimetallic plate is deformed to cut off the circuit, because of the improper arrangement of the parts as mentioned above, the bimetallic plate could deform to re-connect the two contact points to connect the circuit again. Because of the inaccuracy of the deformation of the bimetallic plate, the switch member does not set to the "OFF" position after the bimetallic plate is deformed to cut off the circuit.

Therefore, it is desired to have a safety switch that allows the bimetallic plate to deform toward a desired direction when overloaded and the bimetallic plate is freely deformed to prevent the bimetallic plate from bouncing back to re-connect the circuit again.

SUMMARY OF THE INVENTION

In accordance with an aspect of the present invention, there is provided a safety switch, which comprises a body with a switch member pivotably engaged with the top opening of the body. An extension extends from a first end of an underside of the switch member and a push rod is pivotably connected to an inside of the switch member. A stop rod extends from the inside of the switch member and locates at a distance from a pivot position of the push rod. A biasing member is connected to the push rod and pushes the push rod toward the stop rod. A first terminal and a second terminal extend through a bottom of the body. A contact plate has a first end fixed to the first terminal and a second end of the contact plate is a free end. A contact portion splits from the contact plate and a first contact point is connected to an underside of the contact portion. A free end of the contact portion is located above a top surface of the contact plate and connected with a free first end of a spring member. A second end of the spring member is connected to the contact plate. A second contact point is connected to the second terminal and locates beneath the first contact point on the contact portion. The second end of the contact plate and the free end of the contact portion are deformed in opposite directions when being heated. The push rod is located at right side of the spring member when in "ON" position so that when overloaded, the contact portion is deformed clockwise to separate the two contact points and the spring member pushes the push rod away to allow the clockwise movement of the spring member to be completed.

The main object of the present invention is to provide a safety switch which provides a push rod pivotably connected to the switch member so as to push the spring member when setting the switch in "ON" position, and the push rod does not stop the clockwise movement of the spring when overloaded.

Another object of the present invention is to provide a safety switch, wherein the switch member is automatically set at "OFF" position after overloaded.

Yet another object of the present invention is to provide a safety switch that includes less number of parts so as to have lower manufacturing cost.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
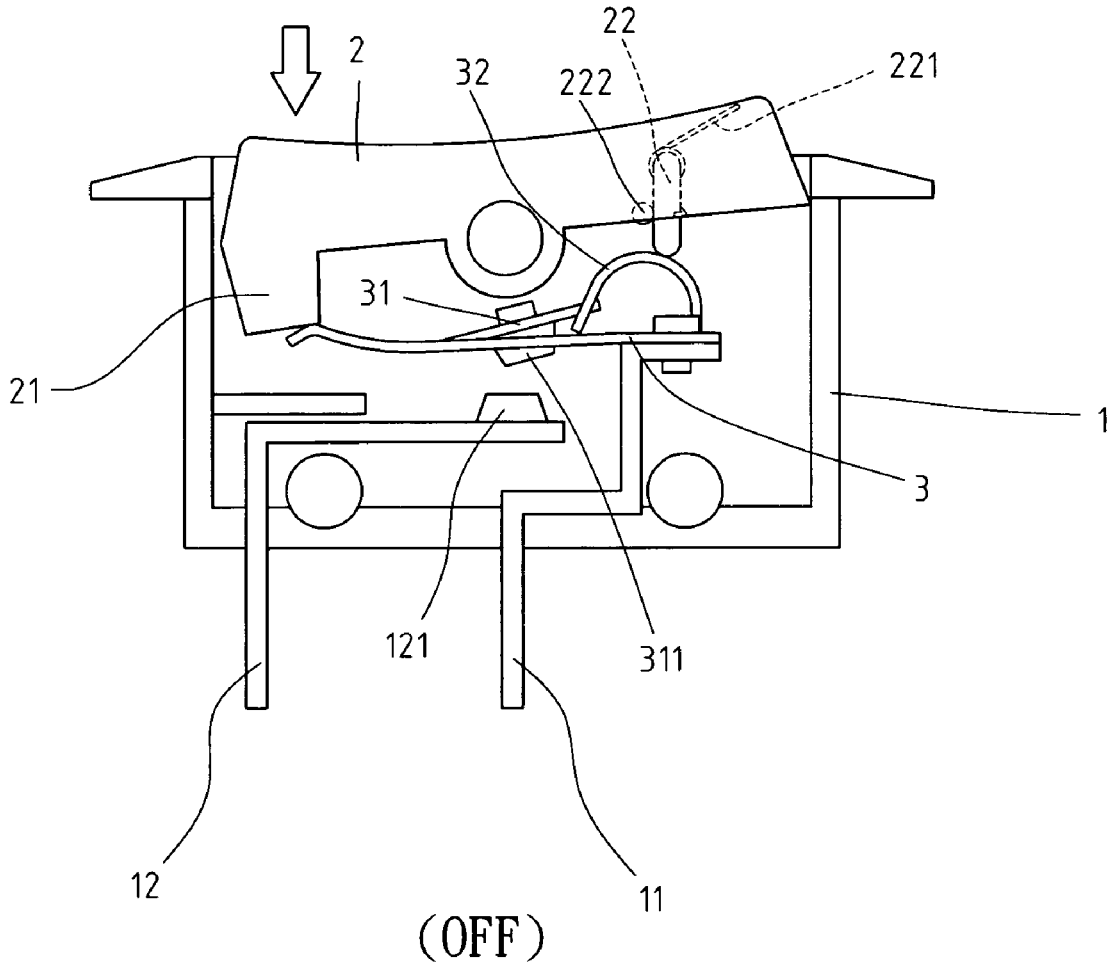
FIG. 1 is a sectional view showing the "OFF" status of a safety switch in accordance with the present invention.
Figure 2:
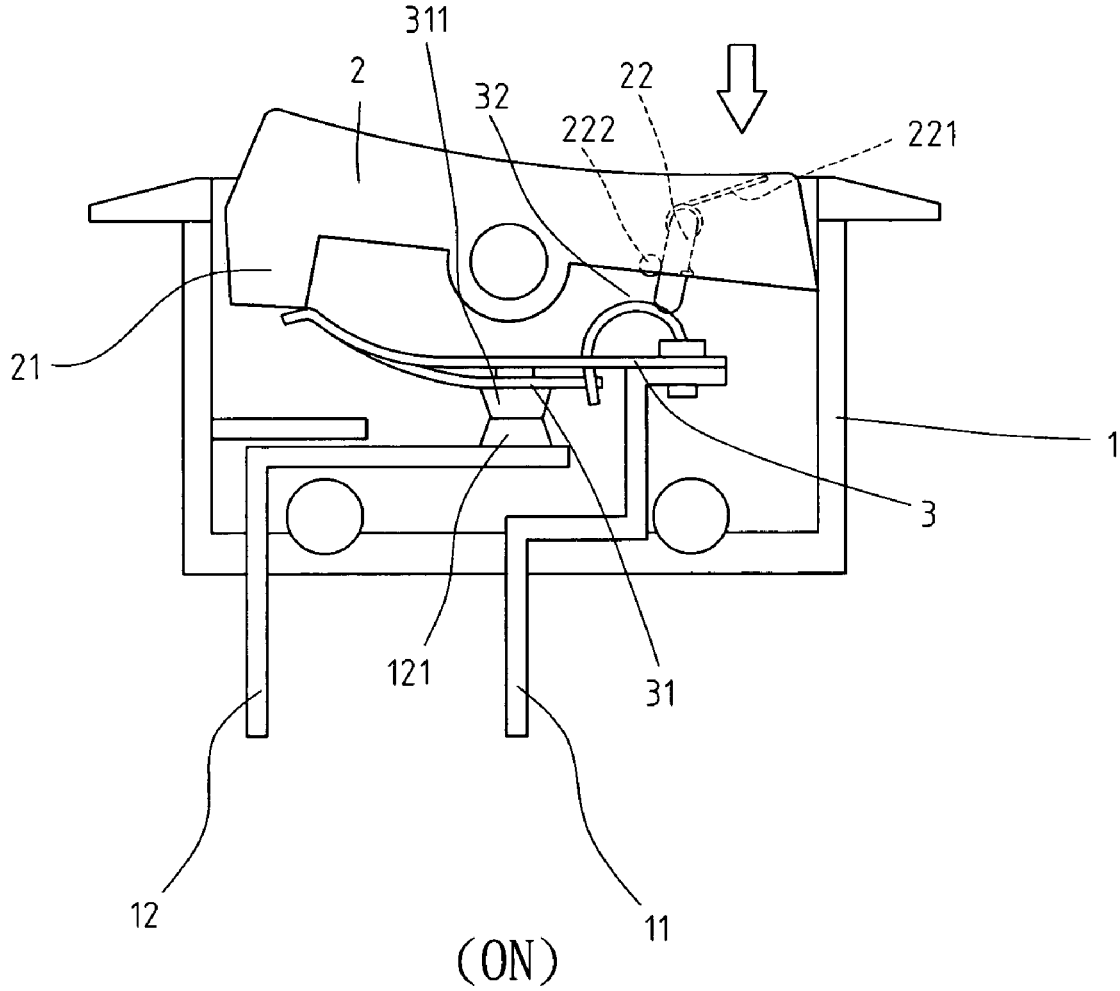
FIG. 2 is a sectional view showing the "ON" status of the safety switch of the present invention.
Figure 4:
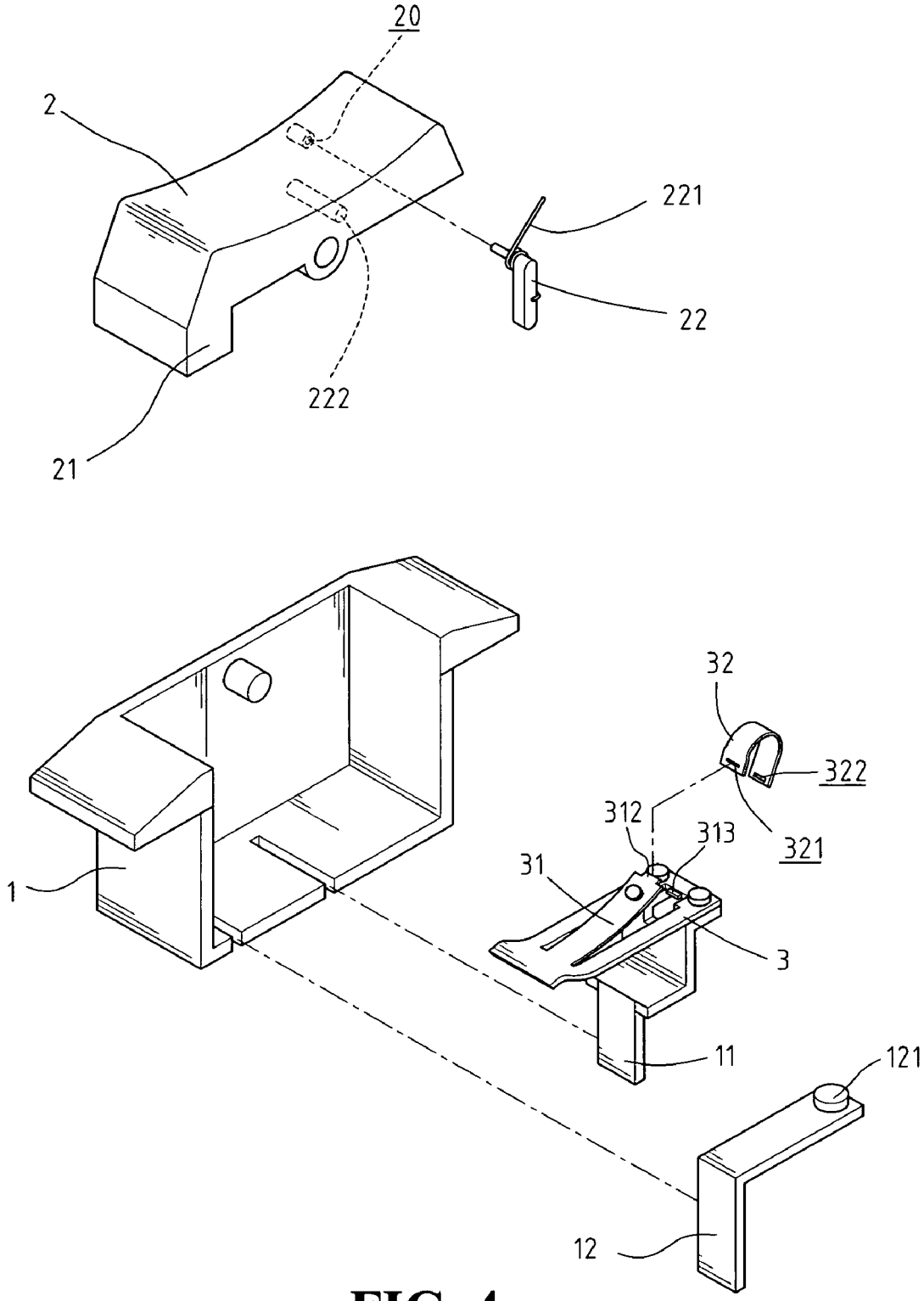
FIG. 4 is an exploded view of the safety switch in accordance with the present invention.

Referring to the drawings and in particular to FIGS. 1, 2 and 4, a safety switch in accordance with the present invention comprises a body 1 with a top opening and a switch member 2 pivotably engaged with the top opening of the body 1 such that the switch member 2 is pivoted about a pin at a middle portion thereof. An extension 21 extends from a first end of an underside of the switch member 2 and a reception hole 20 is defined in an inside of the switch member 2. A push rod 22 includes an insertion extending transversely from an end thereof and the insertion is pivotably inserted into the reception hole 20. A stop rod 222 extends from the inside of the switch member 2 and locates at a distance from the pivot position of the push rod 22. A biasing member 221 such as a torsion spring is mounted to the insertion and includes two legs, one leg contacts against the underside of the switch member 2 and the other leg is connected to the push rod 22. By this arrangement, the push rod 22 is pushed toward the stop rod 222 by the biasing member 221.

A first terminal 11 and a second terminal 12 extend through a bottom of the body 1. A contact plate 3 which is a curved and flexible bimetallic plate and a first end of the contact plate 3 is fixed to the first terminal 11 and a second end of the contact plate 3 is a free end. A contact portion 31 splits from the contact plate 3 and a first contact point 311 is connected to an underside of the contact portion 31. A second contact point 121 is connected to the second terminal 12 and located beneath the first contact point 311 on the contact portion 31. A free end of the contact portion 31 is located above a top surface of the contact plate 3 and connected with a free first end of a U-shaped spring member 32. The free end of the contact portion 31 has a tongue 312 and the free first end of the spring member 32 has a first slot 321 with which the tongue 312 is engaged. A second end of the spring member 32 has a second slot 322. A ridge 313 extends from an inner periphery of an opening from which the contact portion 31 splits, and the ridge 313 is engaged with the second slot 322. The second end of the contact plate 3 and the free end of the contact portion 31 are deformed in opposite directions when being heated.

The extension 21 of the switch member 2 is located above the second end of the contact plate 3 and presses the second end of the contact plate 3 downward when the switch member 2 is in "OFF" position as shown in FIG. 1. When the second end of the switch member 2 is pushed downward to "ON" position, the spring member 32 is pushed by the push rod 22 to lower the first contact point 311 to be in contact with the second contact point 121. After the spring member 32 is pushed downward, the push rod 22 is located at right side of the spring member 32.

Figure 3:
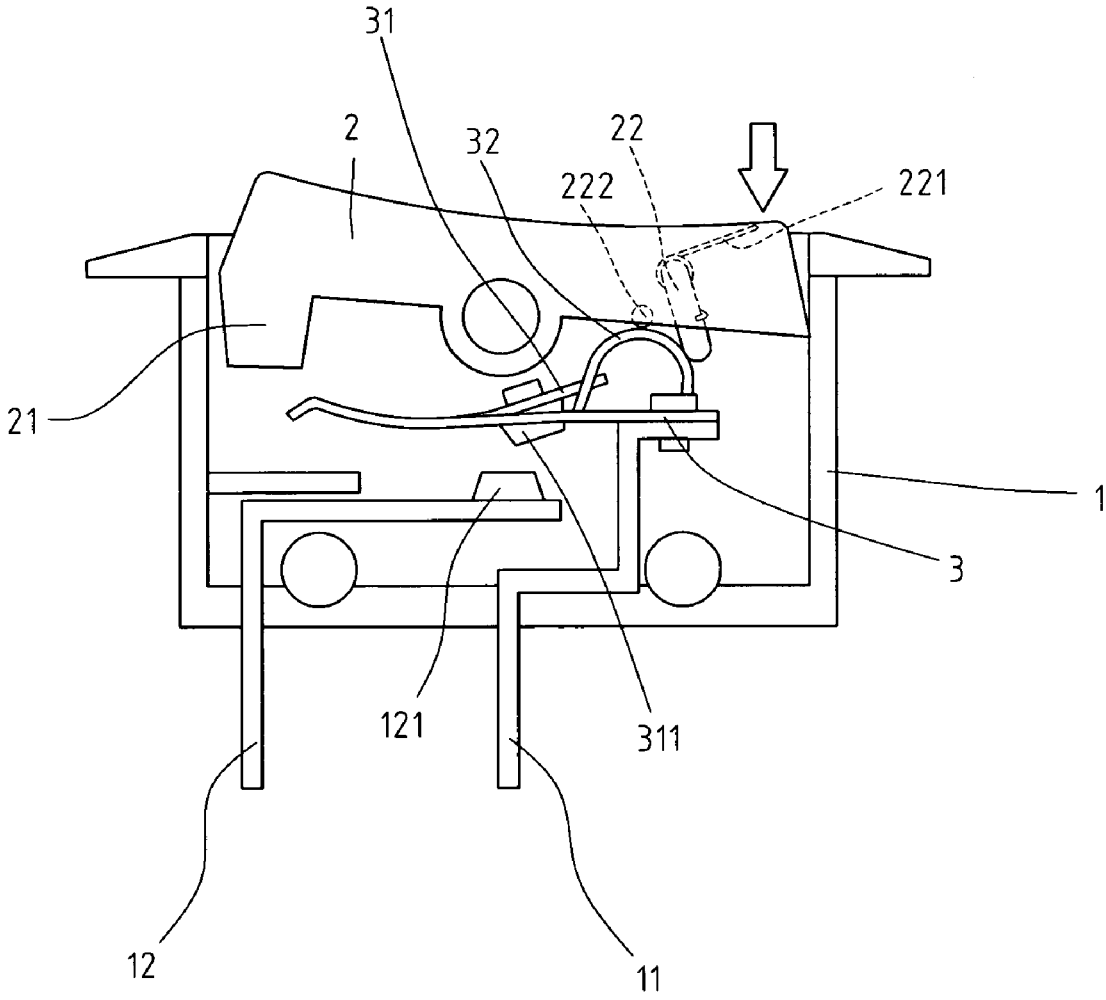
FIG. 3 shows that when overloaded, a push rod locates at right side of a spring member and does not stop the clockwise movement of the spring member.

As shown in FIG. 3, when overloaded, the contact portion 31 is deformed upward and the free end of the contact plate 3 is deformed downward so as to separate the two contact points 311, 121 to cut off the circuit. The spring member 32 is rotated clockwise about the second end of the spring member 32 together with the upward movement of the contact portion 31, and the push rod 22 is then pushed away to allow the movement of the spring member 32 to be completed. In the meanwhile, the leg contacting against the underside of the switch member 2 pushes the switch member 2 which is then pivoted to "OFF" position.

While we have shown and described the embodiment in accordance with the present invention, it should be clear to those skilled in the art that further embodiments may be made without departing from the scope of the present invention.

What is claimed is:

1. A safety switch, comprising a body with a top opening and a switch member pivotably engaged with the top opening of the body, an extension extending from a first end of an underside of the switch member and a push rod pivotably connected to an inside of the switch member, a stop rod extending from the inside of the switch member and locating at a distance from a pivot position of the push rod, a biasing member connected to the push rod and pushing the push rod toward the stop rod, a first terminal and a second terminal extending through a bottom of the body; and a contact plate being a curved and flexible metal plate and having a first end fixed to the first terminal and a second end of the contact plate being a free end, a contact portion splitting from the contact plate and a first contact point connected to an underside of the contact portion, a free end of the contact portion located above a top surface of the contact plate and connected with a free first end of a spring member, a second end of the spring member connected to the contact plate, a second contact point connected to the second terminal and located beneath the first contact point on the contact portion, the second end of the contact plate and the free end of the contact portion being deformed in opposite directions when being heated, and the extension of the switch member located above the second end of the contact plate.

2. The safety switch as claimed in claim 1, wherein the free end of the contact portion has a tongue and the free first end of the spring member has a first slot with which the tongue is engaged.

3. The safety switch as claimed in claim 1, wherein the second end of the spring member has a second slot, and a ridge extends from an inner periphery of an opening from which the contact portion splits and the ridge is engaged with the second slot.

4. The safety switch as claimed in claim 1, wherein the spring member is a U-shaped member.

5. The safety switch as claimed in claim 1, wherein the contact plate is a bi-metallic plate.

6. The safety switch as claimed in claim 1, wherein a reception hole is defined in the inside of the switch member and the push rod includes an insertion which is inserted into the reception hole.

7. The safety switch as claimed in claim 6, wherein the biasing member is a torsion spring, which is mounted to the insertion and includes two legs, one leg contacting against the underside of the switch member and the other leg being connected to the push rod.

* * * * *